United States Patent [19]

Hayes

[11] Patent Number: 4,527,720

[45] Date of Patent: Jul. 9, 1985

[54] PAINT CAN HOLDER OR THE LIKE

[76] Inventor: Arthur R. Hayes, Rte. 3, Box 357, Rocky Mount, N.C. 27801

[21] Appl. No.: 537,103

[22] Filed: Sep. 29, 1983

[51] Int. Cl.[3] ..... A46B 17/00

[52] U.S. Cl. ..... 224/148; 224/197

[58] Field of Search ..... 224/148, 268, 195, 197, 224/224, 225, 226, 254, 255, 269, 271, 904, 907

[56] References Cited

U.S. PATENT DOCUMENTS

| | | | |
|---|---|---|---|
| 913,171 | 2/1909 | Smith | 224/226 |
| 1,494,183 | 5/1924 | Ohman | 224/268 |
| 2,985,349 | 5/1961 | McGuire | 224/268 |
| 3,285,482 | 11/1966 | Bedsaul, Sr. | 224/268 |
| 3,493,152 | 2/1970 | Ort | 224/268 |
| 4,325,503 | 4/1982 | Swinney | 224/148 |

*Primary Examiner*—Stephen Marcus
*Assistant Examiner*—David Voorhees
*Attorney, Agent, or Firm*—Mills & Coats

[57] ABSTRACT

This invention adapted to be suspended from the belt of the user thereof and supports a container such as a paint bucket by the bail thereof. Due to an additional pivot in the device, the container will remain level and not spill the contents thereof as the user moves about.

7 Claims, 2 Drawing Figures

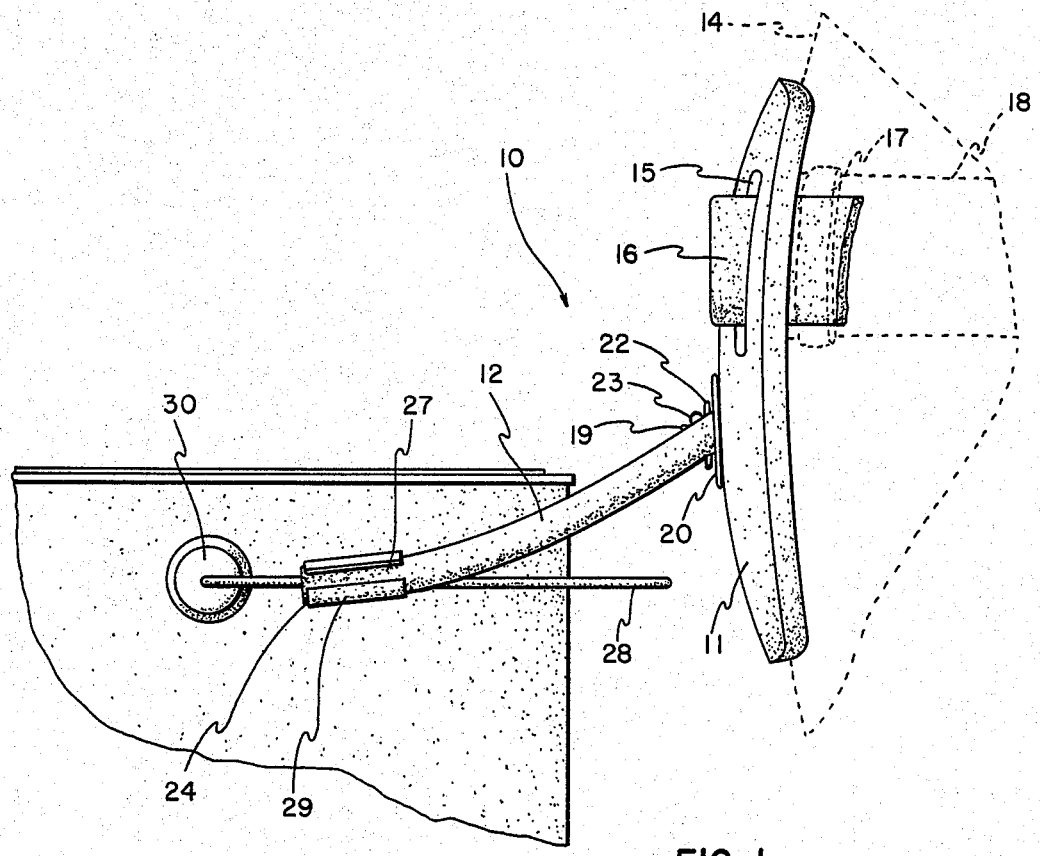
FIG. 1
FIG. 2
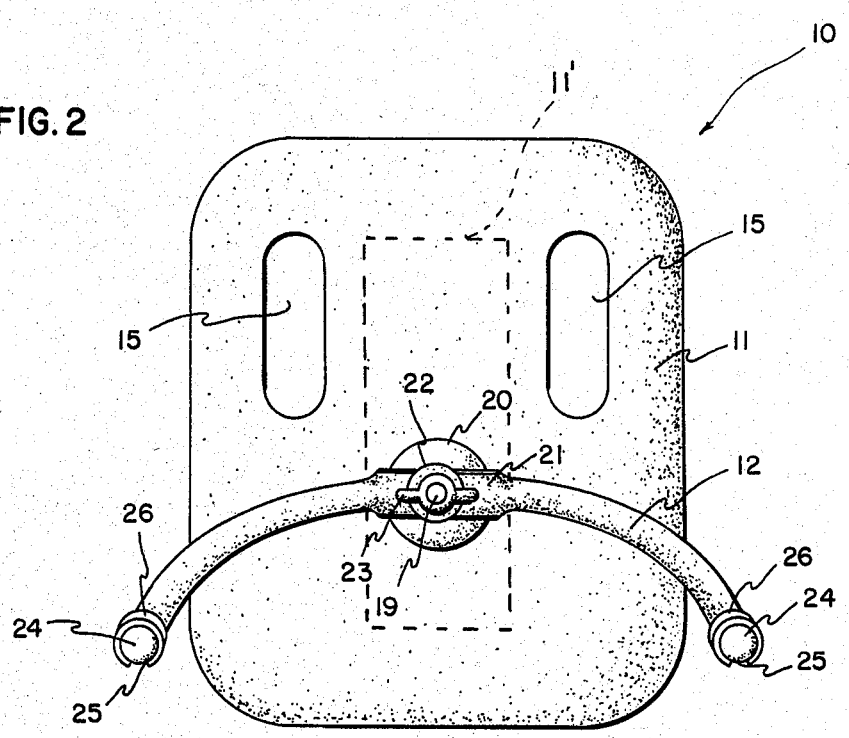

PAINT CAN HOLDER OR THE LIKE

FIELD OF INVENTION

This invention relates to containers and more particularly to mobile supports for the same.

BACKGROUND OF INVENTION

Since man first began to put protective coatings on surfaces about him, supporting the coating container convenient to work area has been a problem.

Ladder platforms and container suspension hooks have been used but these are inconvenient as the user moves up and down the ladder. Also the container must be removed each time the position of the ladder is shifted or great risk of spillage will occur.

Attempts have been made to suspend bucket like container from the body of the user thereof but in most cases these means have included special containers and even at that have not been so structured that they would self-level in all axis.

BRIEF DESCRIPTION OF INVENTION

After much research and study into the above-mentioned problems, the present invention has been developed to provide a means for supporting a container conveniently adjacent the user thereof and which will at all times remain level even during reaching, bending, leaning, stooping, and any other position normally taken by the persons using the same.

The above is accomplished through the provision of a means supported by the belt of the user thereof and which engages the bail type handle which is normally found on paint and similar type containers. A separate pivot means is also provided which effectively gives a second axis 90 degrees to where the bail attaches to the can thereby providing for universal gimbled movement.

In view of the above, it is an object of the present invention is to provide, in a container support, a system utilizing the bail of the container as one axis of rotation for a multi-axis support system.

Another object of the present invention is to provide a relatively inexpensive and yet highly efficient gimbled support means.

Another object of the present invention is to provide a relatively simple container support means which can be readily connected and disconnected to and from the bail of the container.

Another object of the present invention is to provide a support means for a paint type container which at all times is disposed convenient to the user thereof.

Other objects and advantages of the present invention will become apparent and obvious from a study of the following description and the accompanying drawings which are merely illustrative of such invention.

BRIEF DESCRIPTION OF FIGURES

FIG. 1 is a side elevational view of the paint can holder or the like of the present invention; and FIG. 2 is a front elevational view thereof.

DETAILED DESCRIPTION OF INVENTION

With further reference to the drawings, the paint can holder or the like of the present invention, indicated generally at 10, includes a backing member 11 and a bail support member 12.

The backing member is slightly curved as can clearly be seen in FIG. 1 so that it will contour to the hip of the user 14 thereof. A pair of elongated slot-like openings 15 are provided in backing 11 and are adapted to supportingly receive the belt 16 worn by the user 14. This belt would be the belt normally worn by such user and is threaded through the belt loops 17 of his pants 18.

A threaded screw-like shaft 19 extends outwardly from the lower central portion of backing 11 and is secured to backing plate 11' which is either embedded in backing 11 or lies juxtaposed to the inside thereof. A bearing surface such as washer 20 is placed over shaft 19 juxtaposed to backing 11.

The central portion 21 of bail support member 12 is flattened and has an opening therein for receiving shaft 19. A second bearing surface such as washer 22 is provided on the side of central portion 21 opposite washer 20. Finally a securing means such as wing nut 23 is used to not only secure the washers relative to the bail support member but also to adjust the tension thereon.

As can clearly be seen from the Figures, the bail support member 12 is preferably arcuate in configuration. The outer ends 24 of this arcuate member have an elongated slot 25 formed therein. A bail locking sleeve 26 is rotatively provided on each of the ends 24 . Each of these sleeves are not completely closed thereby leaving a slot-like opening 27 in the side thereof.

When the slot-like opening 27 of each of the sleeves 26 is aligned with the elongated slot 25 of its associated end portion 24, the bail 28 of container 29 can be laid into the interior of the support member.

When the locking sleeve 26 is rotated to misalign slot 25 and opening 27, as shown in FIG. 1, the container bail 28 is grippingly secured to the ends 24 of member 12. To release the container bail 28, the locking sleeve is simply rotated so that the slot 25 and opening 27 are again in alignment and the bail simply removed from the interior of such member 12.

The bail 28 of container 29 is rotatively mounted at connection 30 on either side thereof thus forming a generally horizontal axis of rotation. Since the connections 30 are at the upper portion of container 29, the weight of such container will cause the same to remain upright by pivoting about the bail axis.

Since the bail support member 12 is pivotably mounted on threaded shaft 19, this forms a second axis of rotation perpendicular to the container bail axis of rotation. Again, due to the fact that the majority of the mass of the container 29 is below this second mentioned axis, the container will by gravity remain in an upright position regardless of the movement of the user 14 thereof.

In other words if the device 10 of the present invention is mounted on the side of the hip of the user 14, as the user leans or sways from side to side, the container will rotate about the container bail axis and remain level. As the user leans forward or backward, the weight of the container 14 will cause pivoting movement about the axis of shaft 19 and the can will continue to remain level. Likewise compound movements, for example leaning forward and to one side simultaneously, will be compensated for by movement about both the bail axis and the shaft axis.

To use the device of the present invention, the user 14 loosens his belt 16 and threads it through slots 15 of backing member 14. He then passes his belt back through belt loop 17 of his pants 18 and connects the belt in the normal manner.

Next the locking sleeves 26 are rotated to align the slot 15 in bail member 12 with the opening 27 in such sleeve. The bail 28 of the container 29 is then laid into these aligned openings and is secured to the ends 14 of such support member by rotating the locking sleeves to a position of misalignment. The user is then ready to climb ladders, lean over railings, stoop, bend, or whatever other movements are necessary to accomplish his work all the while being confident that the container 29 will remain in an upright orientation and will at all times be available at his side when he needs the same.

Once the painting or other use of the container 29 has been completed, the backing member 11 can simply be removed from the user's belt 16 and the container with the present invention still attached set aside or, of course, the locking sleeves can be rotated and the device removed from the bail 28 as hereinabove discussed.

From the above it can be seen that the present invention has the advantage of providing a relatively simple and yet highly efficient means of assuring that a container will at all times remain adjacent the user thereof and will also at all times remain in an upright or level position. The present invention is easily connected to and disconnected from both the user and the container and will greatly increase productivity of painters, windwow washers, and similar users thereof.

The present invention can, of course, be carried out in other specific ways than those herein set forth without departing from the spirit and essential characteristics of the invention. The present embodiments are, therefore, to be considered in all respects as illustrative and not restrictive, and all changes coming within the meaning and equivalency range of the appended claims are intended to be embraced therein.

What is claimed is:

1. A support means for use in connection with a container having a bail-like handle pivotally connected thereto comprising a backing means; a bail support means rotatively mounted on said backing and outwardly projecting therefrom so that its axis of rotation lies on a plane generally perpendicular to the axis of rotation of said bail-like handle of said supported container; means adjacent the outer portion of said support means for engaging each end of said bail adjacent to its pivoted connections with said container; means for securing said bail to said support means; and mounting means for said backing means whereby said container can be mounted adjacent to but away from the body of the user thereof and will remain level during normal movement.

2. The means of claim 1 wherein the means for mounting said backing is a belt-like means.

3. The means of claim 2 wherein said belt is a garment type belt.

4. The means of claim 1 wherein said backing is contoured.

5. The means of claim 1 wherein when said backing is generally in an upright position said support will engagedly hold said bail in a generally horizontal position whereby ready access to the contents of said container is provided.

6. The means of claim 1 wherein the means adjacent the outer portion of said support means for engaging said bail is in the form of a rotatable, slotted sleeve for receiving and engaging said bail.

7. The means of claim 1 wherein a friction control means is provided for the rotatively mounted bail support means.

* * * * *